US005797786A

United States Patent [19]

Smith et al.

[11] Patent Number: 5,797,786

[45] Date of Patent: Aug. 25, 1998

[54] POST OPERATIVE BRASSIERE

[76] Inventors: Joey Paulette Smith; Gerald William Smith, both of 5009 Zebulon Rd., Zebulon, N.C. 27597

[21] Appl. No.: 691,539

[22] Filed: Aug. 2, 1996

Related U.S. Application Data

[60] Provisional application No. 60/001,928 Aug. 4, 1995.

[51] Int. Cl.[6] ..... A41B 3/00

[52] U.S. Cl. ..... 450/1; 450/64; 450/65; 450/66; 450/67; 450/68; 450/86; 450/58; 2/67; 2/73

[58] Field of Search ..... 2/67, 105, 106, 2/1; 11/73; 450/1, 86, 64, 65, 66, 67, 68, 58, 74, 75, 76

[56] References Cited

U.S. PATENT DOCUMENTS

| | | | |
|---|---|---|---|
| 494,397 | 3/1893 | Tucek | 450/53 |
| 2,378,906 | 6/1945 | Blum | 450/87 OR |
| 2,520,225 | 8/1950 | Scott-Elliot | 450/67 |
| 3,306,299 | 2/1967 | Paramore | 450/86 X |
| 3,465,754 | 9/1969 | Lockwood et al. | 450/86 X |
| 5,211,598 | 5/1993 | Hall | 450/65 X |

FOREIGN PATENT DOCUMENTS

| | | | |
|---|---|---|---|
| 285758 | 9/1952 | Switzerland | 450/51 |

OTHER PUBLICATIONS

Gershman, Maurice, "Self Adhering Nylon Tapes," The J. A. M. A, vol. 168, No. 7, p. 930, Oct. 1958.

*Primary Examiner*—Jeanette E. Chapman

*Attorney, Agent, or Firm*—Mills Law Firm; Clifford F. Rey

[57] ABSTRACT

A post-operative brassiere for use by female patients following cardio-thoracic surgery is disclosed. The post-operative brassiere includes a first breast support cup and a second breast support cup being interconnected by a support strap which is worn about the neck and shoulders of the wearer so as to form an open gap between the first and second breast support cups over the area of the wearer's sternum whereon a surgical incision is located. The conventional torso encircling straps which overlie the sternum in brassieres of the prior art are eliminated. The post-operative brassiere allows access to the incision for routine examination and nursing care while providing adequate support to the wearer's breasts. In one embodiment the breast support cups include elastic panels disposed about the peripheral edges thereof to secure the same in position. In an alternative embodiment, the breast support cups include resilient underwire support means disposed within the elastic panels to counteract the natural downward and lateral pressure exerted by the weight of the breasts against the mid-sternal incision. The support strap extending about the neck and shoulders of wearer is provided with length adjustment means in order to vary the length and thereby adjust the tension created in the elastic panels within each breast support cup to provide a comfortable fit for an individual patient.

10 Claims, 3 Drawing Sheets

POST OPERATIVE BRASSIERE

This application claims the benefit of U.S. Provisional Application No. 60/001,928 filed Aug. 4, 1995, by Paulette Smith for Post Operative Bra.

BACKGROUND OF INVENTION

Field of Invention

This invention is related to brassieres and, more particularly, to brassieres suitable for post-operative use by female patients following thoracic surgery.

Traditional brassieres having an elastic band portion adapted to encircle a women's torso so as to support the breasts are not entirely suitable for use by female patients following thoracic surgery.

Such surgery generally requires an incision which extends along the midline of the chest and is typically secured by means of sutures or external staples. The surgical incision initially requires frequent wound care and dressing changes which makes the use of a conventional bra impractical for post-operative use.

Although post-operative brassieres are known in the prior art, such devices persist in the use of elastic straps or panels which overlie the mid-sternal incision line thereby inhibiting ventilation of the incisional wound and limiting access to the incision for purposes of examination and nursing care.

In addition, the post-operative brassieres of the prior art typically include some form of shoulder strap through which the wearer's arms must be positioned causing considerable stress on the incision and pain and discomfort due to the physical movement required to put on the brassiere.

For example, a surgical brassiere for reducing stress along a mid-sternal incision line of a female patient following cardio-thoracic surgery is disclosed in U.S. Pat. No. 4,804,351. This surgical brassiere includes a pair of inner straps detachably secured across the gap between the bust support cups. Also, this brassiere includes shoulder straps through which the wearer's arms must be positioned causing considerable discomfort.

Further, the prior art devices invariably include a fastening means for securing the brassiere about the torso which can be difficult for the post-operative patient to manipulate.

U.S. Pat. No. Des 300,980 discloses the ornamental design for a brassiere having a criss-cross type strap arrangement between the bust support cups and extending about the torso of the wearer. The torso strap includes fastening means for securing the same which are difficult for a surgical patient to manipulate due to the physical movement required.

As a result of these problems, the post-operative use of a brassiere may be avoided by the patient due to the discomfort associated with the use of the same, which can interfere with effective healing and significantly extend the post-operative recovery period.

Thus, the post surgical brassiere of the present invention has been developed to solve these problems by eliminating any straps which would extend between the bust support cups to form a completely exposed gap over the area of the patient's mid-sternal incision line.

DESCRIPTION OF RELATED ART

U.S. Pat. No. 4,804,351 to Nancy M. Raml, et al. discloses a surgical brassiere for reducing stress along a mid-sternal incision line of a female patient following cardio-thoracic surgery. However, this brassiere includes shoulder straps and a pair of inner straps detachably secured across the gap between the bust support cups together with a ventilated panel which necessarily overly the patient's incisional line.

U.S. Pat. No. 5,024,628 to Mary M. Sanchez discloses a maternity and nursing bra incorporating a one-handed fastening method that allows for a stronger cup support and variable adjustment of cup size.

U.S. Pat. No. 3,429,682 to Albert C. Defru discloses a therapeutic brassiere utilizing an inner support band constructed of stiffened laminate material to carry a wearer's breast and to support them from underneath.

U.S. Pat. No. 5,037,348 to Frank G. Farino discloses a therapeutic brassiere for supporting breast implants with breast receiving cups. A chest encircling band is enjoined to the lower marginal edges of the cups for affixing the brassiere to the chest of the wearer.

Finally, U.S. Pat. No. Des. 300,980 to Joanne G. Mathis discloses the ornamental design for brassiere as shown and described therein.

SUMMARY OF THE INVENTION

After much research and study of the above mentioned problems, the present invention has been developed to provide a post-operative brassiere which completely eliminates the conventional torso straps that interconnect the bust support cups so as to form an exposed gap over the area of the patient's mid-sternal incision line to help promote healing and recovery.

This is accomplished by providing the post-operative brassiere of the present invention with elastic panels which extend about the periphery of the breast support cups to counteract the natural downward and lateral pressure exerted on a mid-sternal incision by the weight of the breasts.

The elastic panels within each individual breast support cup are interconnected by an adjustable support strap extending around the neck and shoulders of the wearer. By adjusting the length of the support strap, the tension created within the elastic panels may be varied to fit the brassiere to a particular patient.

A particularly salient feature of the present invention is that no other fasteners are required to secure the post-operative brassiere in position.

In view of the above, it is an object of the present invention to provide a new and improved brassiere which is particularly well adapted for use with female patients following cardio-thoracic surgery.

Another object of the present invention is to provide a post-operative brassiere which provides ventilation of a mid-sternal incisional line for purposes of routine examination or nursing care.

Another object of the present invention is to provide a post-operative brassiere which gives adequate support during post-operative care to counteract the natural downward and lateral pressure exerted on a mid-sternal incision by the weight of the breasts.

Another object of the present invention is to provide a post-operative brassiere wherein conventional torso straps and related fastening devices are eliminated which minimizes patient discomfort during use of the brassiere.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
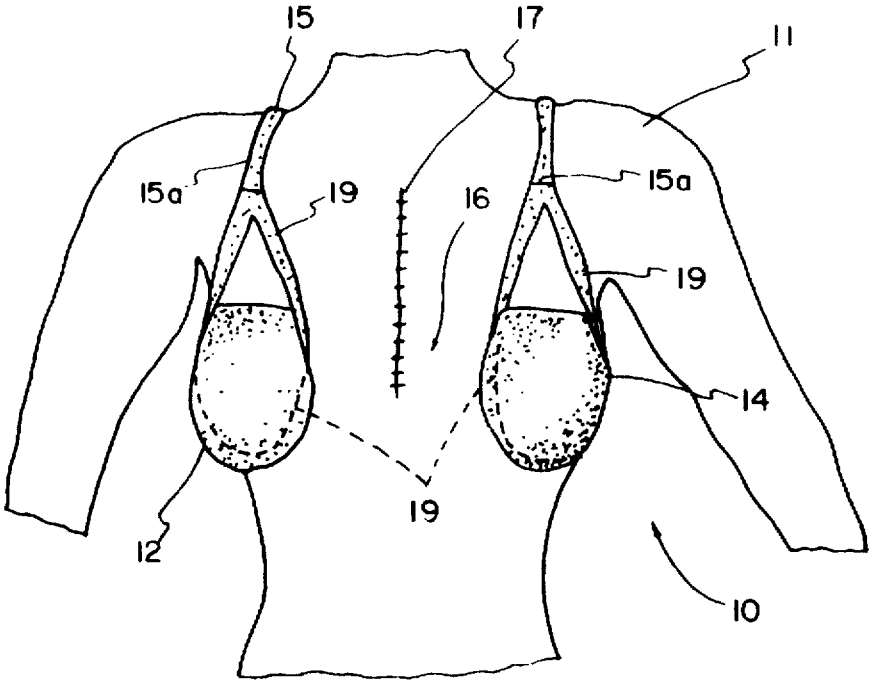
FIG. 1 is a front elevational view of the post-operative brassiere of the present invention disposed on the torso of a woman patient.

With reference to the drawings, a post-operative brassiere in accordance with the present invention is illustrated in FIG. 1 and indicated generally at 10. Brassiere 10 comprises a flexible garment adapted to be worn about the neck and torso of a female patient 11 so as to support the patient's breasts.

Brassiere 10 includes a first breast support cup 12 and a second breast support cup 14 which are fabricated to overlie and support the right and left breasts, respectively, of the patient 11. In addition, a flexible support strap 15 is provided to be worn about the neck of patient 11 for supporting the first and second breast cups 12 and 14 over the breasts of the patient 11.

In the preferred embodiment of the present invention the upper portions of each breast support cup 12 and 14 together with support strap 15 are fabricated of a cotton-polyester fabric having elasticity. In order to provide increased comfort, each breast support cup 12 and 14 may be provided with a quilted lining sewn with elastic thread.

In an alternative embodiment of the present invention, brassiere 10 may be fabricated from other decorative cloth materials in the manner of a leisure brassiere or lingerie.

In accordance with a principal feature of the present invention, brassiere 10 supports the breasts of the female patient 11 so as to form an open gap as at 16 between the first and second breast support cups 12 and 14 over the area of the sternum whereon the post-operative incision 17 is located.

Thus, when worn by a female patient following thoracic surgery, the gap 16 provided between the first and second breast support cups 12 and 14 provides convenient access to incision 17 which requires frequent nursing care and dressing changes to prevent post-operative infection thereof. In addition, the gap 16 over the patient's sternum promotes drying of the incision 17 to help promote healing and recovery.

Figure 2:
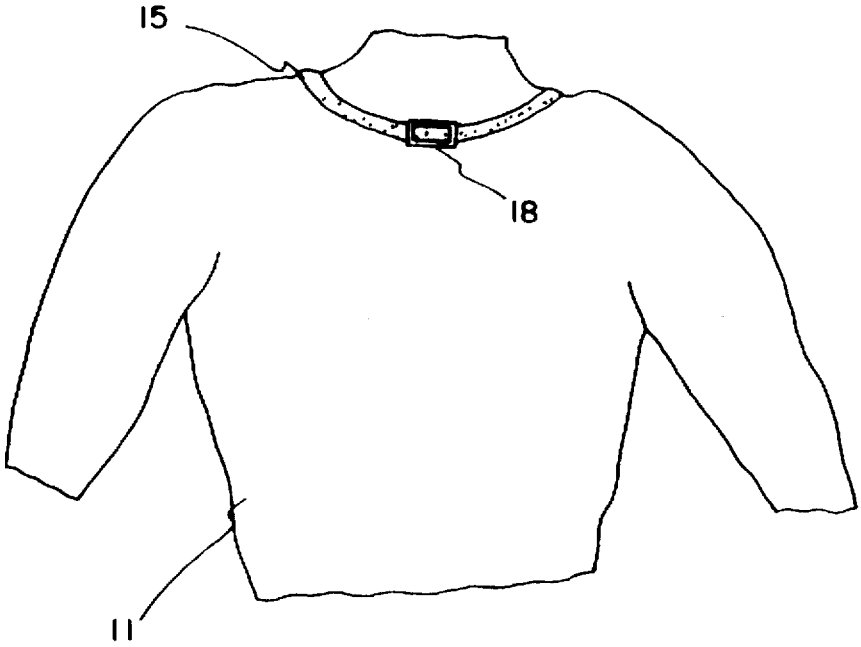
FIG. 2 is a rear elevational view of the post-operative brassiere of the present invention showing the adjustable neck support strap disposed on the torso of a woman patient.

To improve the fit and thereby the comfort during periods of extended wear, support strap 15 may be provided with a length adjustment means 18 as shown in FIG. 2.

In the preferred embodiment, adjustment means 18 may include elongated strips of a hook and loop type fastener sold under the tradename "VELCRO."

In an alternative embodiment, the adjustment means may comprise a conventional sliding buckle 18' which provides for adjustment of neck strap 15 to fit a particular patient.

Since such length adjustment means are well-known to those skilled in the art, further detailed discussion of the same is not deemed necessary.

The post-operative brassiere 10 functions to maintain adequate support of the female patient's breasts so as to avoid undue stress on the incision 17 following thoracic surgery. In particular, post-operative brassiere 10 provides support under the front and along the side of each breast so as to avoid stress along the incision 17.

To accomplish this, both the first and second breast support cups 12 and 14 are provided with elastic panels 19 which extend about the periphery of cups 12 and 14 to counteract the natural downward and lateral pressure exerted on incision 17 by the weight of the breasts.

Brassiere 10 is constructed such that elastic panels 19 within each breast support cup 12 and 14 are interconnected by the terminal ends 15*a* of support strap 15 being attached thereto.

Thus, by use of adjustment means 18, the length of the support strap 15 and the resulting tension created in the elastic panels 19 may be varied to provide adequate support to the wearer.

In the preferred embodiment panels 19 are fabricated from an elastic material such as the type sold under the tradename "SPANDEX."

Since such elastic materials are well known to those skilled in the art, further detailed discussion of the same is not deemed necessary.

Figure 3:
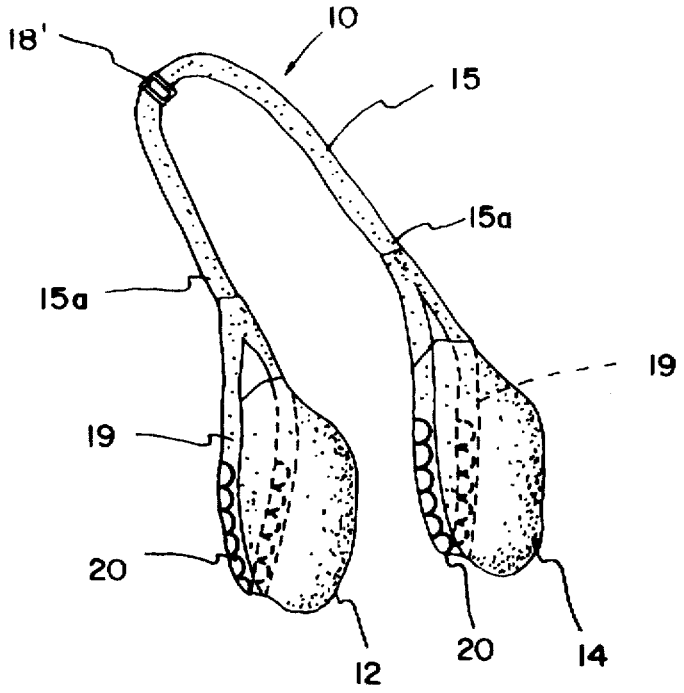
FIG. 3 is a side perspective view of the post-operative brassiere showing the underwire support means.
Figure 4:
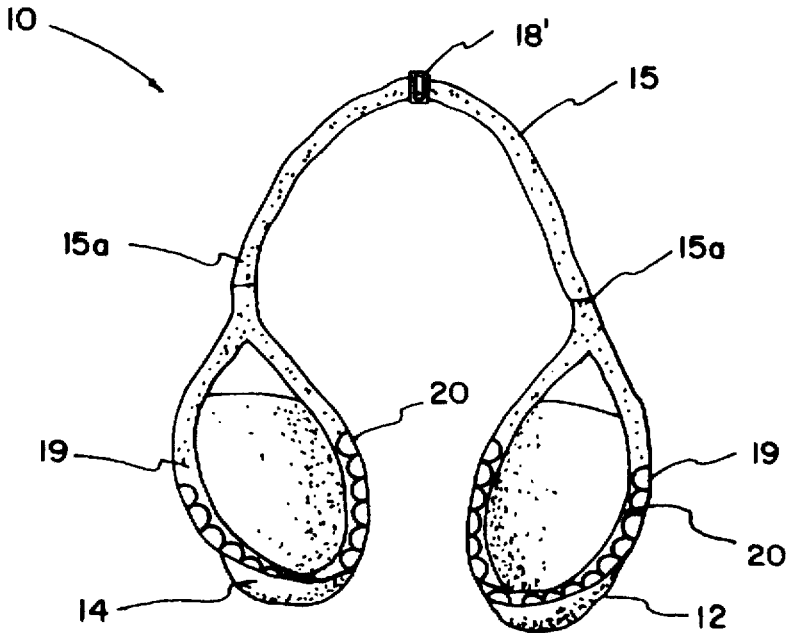
FIG. 4 is a rear perspective view of the post-operative brassiere showing the underwire support means.
Figure 5:
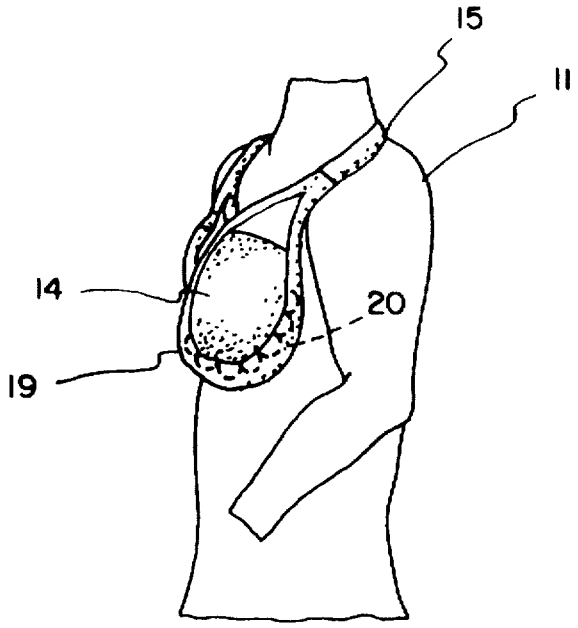
FIG. 5 is a side elevational view of the post-operative brassiere of the present invention including underwire support means being worn on the torso of a woman patient.

In an alternative embodiment of the present invention, brassiere 10 may include flexible underwire support means 20 disposed within panels 19 of cups 12 and 14 to provide additional support as more clearly shown in FIGS. 3–5.

Underwire support means 20 are fabricated from any suitable resilient material such as plastic and arranged in a predetermined pattern within elastic panels 19 as shown in FIG. 3 and 4.

In this arrangement, underwire support means 20 function to maintain the shape of breast support cups 12 and 14 to fit the size and shape of the wearer's breasts.

It is anticipated that the post-operative brassiere 10 will be manufactured in a variety of sizes in the manner of conventional brassieres to fit individual patients.

Another particularly salient feature of the brassiere 10 of the present invention is that no additional fasteners are required to secure the same in position as are found in the prior art. It is anticipated that in the period following surgery the female patient will be bedridden or semi-ambulatory in the normal course of recovery. Thus, by providing the brassiere 10 in a variety of sizes and through the use of length adjustment means 18, such additional fasteners, which are often difficult for the post-operative patient to manipulate, will be unnecessary.

From the above it can be seen that the post-surgical brassiere of the present invention provides a comfortable and functional brassiere for use by female patients following cardio-thoracic surgery.

More particularly, the post-operative brassiere of the present invention eliminates the conventional torso straps which overlie the areas of the patient's sternum whereon the surgical incision is located.

Thus, the post-surgical brassiere provides convenient access to the incision for routine examinations and nursing care while providing adequate support to the wearer's breasts to counteract pressure exerted on the incision by the weight of the breasts.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A brassiere for use by post operative patients, said brassiere comprising:

a first breast support cup, said first breast support cup being fabricated from a flexible cloth material and being provided with a quilted lining sewn with an elastic thread, said cup including elastic panel means disposed about a peripheral edge of said cup for supporting said first cup over one breast of a wearer;

a second breast support cup, said second breast support cup being fabricated from a flexible cloth material and being provided with a quilted lining sewn with elastic thread, said cup including elastic panel means disposed about a peripheral edge of said cup for supporting said second cup over the other breast of the wearer; and flexible strap means interconnecting said panel means within said first and second breast support cups, said flexible strap means extending about the neck and over the shoulders of the wearer so as to create tension within said panel means and to form an open gap between said first and said second breast support cups over the sternum of the wearer without destroying the support provided to the wearer's breasts by said brassiere.

2. The brassiere of claim 1 wherein said strap means includes length adjustment means permitting tension created within said elastic panel means to be varied.

3. The brassiere of claim 2 wherein said length adjustment means includes hook and loop fasteners of the type sold under the tradename Velcro.

4. The brassiere of claim 2 wherein said length adjustment means includes a conventional sliding buckle fastener.

5. The brassiere of claim 1 where said panel means is fabricated from any suitable elastic material.

6. The brassiere of claim 5 where said elastic material is of a type sold under the tradename Spandex.

7. The brassiere of claim 1 wherein said panel means includes underwire support means disposed therein providing additional support to the wearer's breasts.

8. The brassiere of claim 7 wherein said underwire support means is disposed about the periphery of each of said breast support cups so as to counteract the natural downward and lateral pressure exerted by a wearer's breasts.

9. The brassiere of claim 8 wherein said underwire support means is fabricated from any suitable resilient material.

10. The brassiere of claim 1 wherein said flexible cloth material includes decorative fabrics suitable for fashion wear.

* * * * *